US006547415B1

(12) United States Patent
Matthews

(10) Patent No.: US 6,547,415 B1
(45) Date of Patent: Apr. 15, 2003

(54) CLIP-TYPE OBJECT ATTACHMENT SYSTEMS

(75) Inventor: John Wallace Matthews, Newport Beach, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 09/606,605

(22) Filed: Jun. 29, 2000

(51) Int. Cl.[7] ..... A42B 1/24; B43K 25/00
(52) U.S. Cl. ..... 362/191; 24/11 R; 24/11 P
(58) Field of Search ..... 362/190, 191, 362/103, 396, 118; 24/326, 455, 11 R, 11 HC, 11 P

(56) References Cited

U.S. PATENT DOCUMENTS 1,279,186 A * 9/1918 Wahl ..... 24/11 R
2,134,856 A * 11/1938 Burgess ..... 362/191
2,385,640 A * 9/1945 Packer et al. ..... 362/191
2,470,421 A * 5/1949 Woody ..... 24/11 P
3,711,703 A * 1/1973 Bacevius ..... 362/190
4,484,253 A * 11/1984 Roberts ..... 362/206
5,025,966 A 6/1991 Potter ..... 224/183
5,570,965 A * 11/1996 Coolen ..... 24/11 P
5,630,535 A 5/1997 Valenti ..... 224/271

* cited by examiner

*Primary Examiner*—Stephen Husar
*Assistant Examiner*—Bao Truong
(74) *Attorney, Agent, or Firm*—David Weiss

(57) ABSTRACT

A portable device is equipped with a clip for attachment thereof to an object. That device is provided with an undercut groove, and the clip is provided with a head fitting into that undercut groove. The clip is attached to the portable device by fitting that head of the clip into that undercut groove. A portable device may comprise a combination of an undercut groove and a device attachment clip having a head fit into that undercut groove. A clip for attachment of a portable device to an object may have a combination of a bent over end portion and lateral protrusions on that bent over end portion, such as for engagement of undercut sides of a groove in a portable device.

43 Claims, 2 Drawing Sheets

CLIP-TYPE OBJECT ATTACHMENT SYSTEMS

FIELD OF THE INVENTION

The subject invention relates to the field of object attachment systems and to clips for object attachment purposes.

BACKGROUND

Clip systems for attaching sundry devices to other objects are well known and are widely used. One example that readily comes to mind is the standard clip system on STANLEY® brand and other measuring tapes in which a belt clip is attached to the casing of the measuring tape with a screw.

A further development of that concept is apparent from U.S. Pat. No. 5,025,966 by Stephen B. Potter, issued Jun. 25, 1991 for Magnetic Tool Holder. In that refinement, the above mentioned attachment screw in effect is replaced by a magnet that releasably retains the measuring tape or other tool on the belt clip or similar implement.

That prior art also provides a U-shaped receptacle with a dovetail cross section between the belt clip or similar implement and the measurement tape or other tool.

Another example is seen in U.S. Pat. No. 5,630,535 by Paul J. Valenti, issued May 20, 1997 for "Clip for Handgun Support." An embodiment of that clip also uses screws for attachment thereof to a handgun, thereby requiring drilling and tapping of holes into that gun. Another embodiment mentions adhesives for that purpose. Yet another embodiment provides the clip with a U-shaped mounting bracket that fits on a frame member of the handgun. Still another embodiment provides the clip with an angulated fastening flange that is molded into or otherwise attached to one of the grips of the handgun.

SUMMARY OF THE INVENTION

It is a general object of the invention to provide improved clip-type attachment systems for flashlights and other objects.

From one aspect thereof, the invention resides in a method of equipping a portable device with a clip for attachment thereof to an object. That aspect of the invention more specifically resides in the combination of providing such device with an undercut groove, providing the clip with a head fitting into that undercut groove, and attaching that clip to the portable device by fitting that head of the clip into that undercut groove.

From a related aspect thereof, the invention resides in a portable device, comprising, in combination, an undercut groove, and a device attachment clip having a head fit into that undercut groove.

From a related aspect thereof, the invention resides also in a clip for attachment of a portable device to an object, comprising, in combination, a bent over end portion, and lateral protrusions on that bent over end portion.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

MODES FOR CARRYING OUT THE INVENTION

Figure 1:
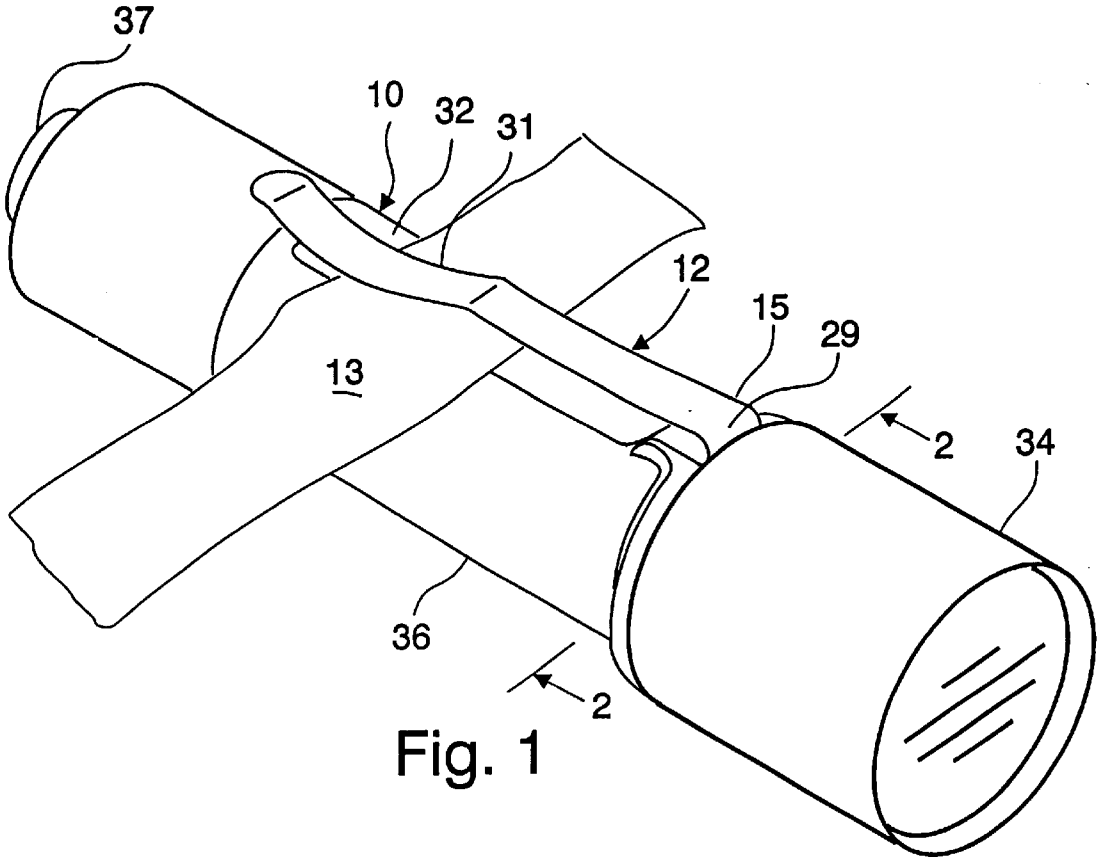
FIG. 1 is a perspective view of a portable device in the form of a flashlight with a clip for attachment thereof to an object, such as a piece of clothing.

The drawings are illustrative of a flashlight 10 or other device equipped with a clip 12 for attachment of such device to a fragmentally illustrated piece of clothing, belt or other object 13, and of method of equipping such portable device with a clip for attachment thereof to an object. Within the scope of the invention, the expression "attachment" in the preceding sentence is intended to be sufficiently broad to cover a holstering of the clip 12 in a holstering device therefor, such as in the type of support bracket shown at 30 in the above mentioned Valenti U.S. Pat. No. 5,630,535 which is hereby incorporated by reference herein.

According to a preferred embodiment of the invention, such portable device 10, comprises a combination of an undercut groove 14 and a clip 12, herein sometimes referred to as "device attachment clip," having a head 15 fit into that undercut groove.

By way of example, the illustrated embodiment provides the portable device 10 with an undercut groove 14 and the clip 12 with a head 15 fitting into that undercut groove, and attaches that clip to that portable device by fitting such head of the clip into the undercut groove of the portable device.

The device 10 may be provided with a flat or other sliding surface 16 for the head 15 of the clip 12 extending into the undercut groove 14 through an opening 17 at one end of the undercut groove 14. The head of the clip may be press-fit into such undercut groove.

According to a preferred embodiment of the invention, the head 15 of the clip is held in the undercut groove 14 by spring action. There may be a resilient mount of the head 15 of the clip in the undercut groove 14, such as more fully disclosed below.

Figure 2:
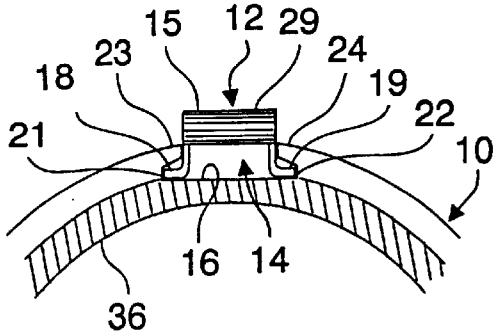
FIG. 2 is a fragment of a section taken on the line 2—2 in FIG. 1 and enlarged.
Figure 4:
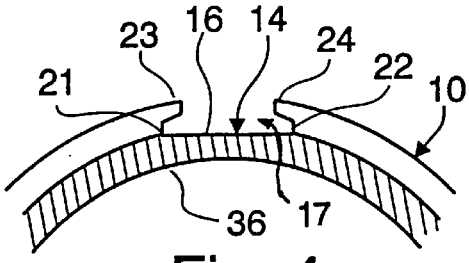
FIG. 4 is a fragment of a section taken on the line 4—4 in FIG. 3 and enlarged.
Figure 6:
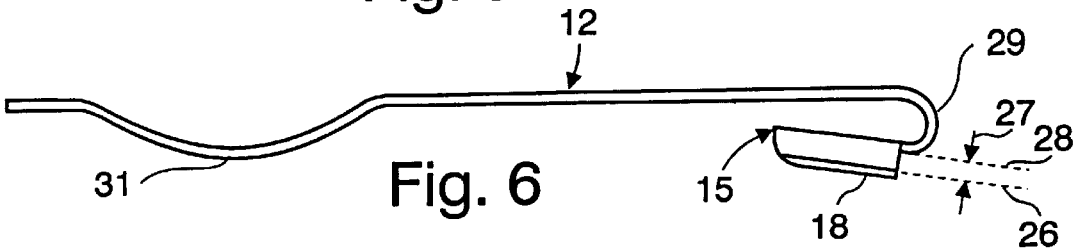
FIG. 6 is a side view of the clip shown in FIG. 1 and in FIG. 5 on an enlarged scale, and ready for insertion into an undercut groove in the portable device, such as in FIG. 3, for completion of the assembly, such as seen in FIG. 1.

Pursuant to an embodiment of the invention, the head 15 of the clip 12 is provided with or has lateral protrusions 18 and 19 fitting into lateral grooves 21 and 22 below overhangs 23 and 24 of the undercut groove 14, such as seen in FIG. 2 with the aid of FIG. 4. As seen in FIGS. 2 and 6, the lateral protrusions 18 and 19 preferably are offset so as to be in a plane 26 spaced, such as by a distance or as seen at 27 from a plane 28 through an adjacent portion of the clip.

According to the illustrated embodiment of the invention, provision of the head 15 of the clip 12 includes bending over a portion of that clip. There thus is a bent over portion or bight portion 29 of the clip at the head of that clip. Pursuant to a preferred embodiment of the invention, an end portion of the clip is bent over so that such portion converges toward an adjacent portion of that clip, such as seen in FIG. 6 which shows the bent over end portion of the clip converging toward an adjacent portion of that clip at the head of that clip.

Figure 3:
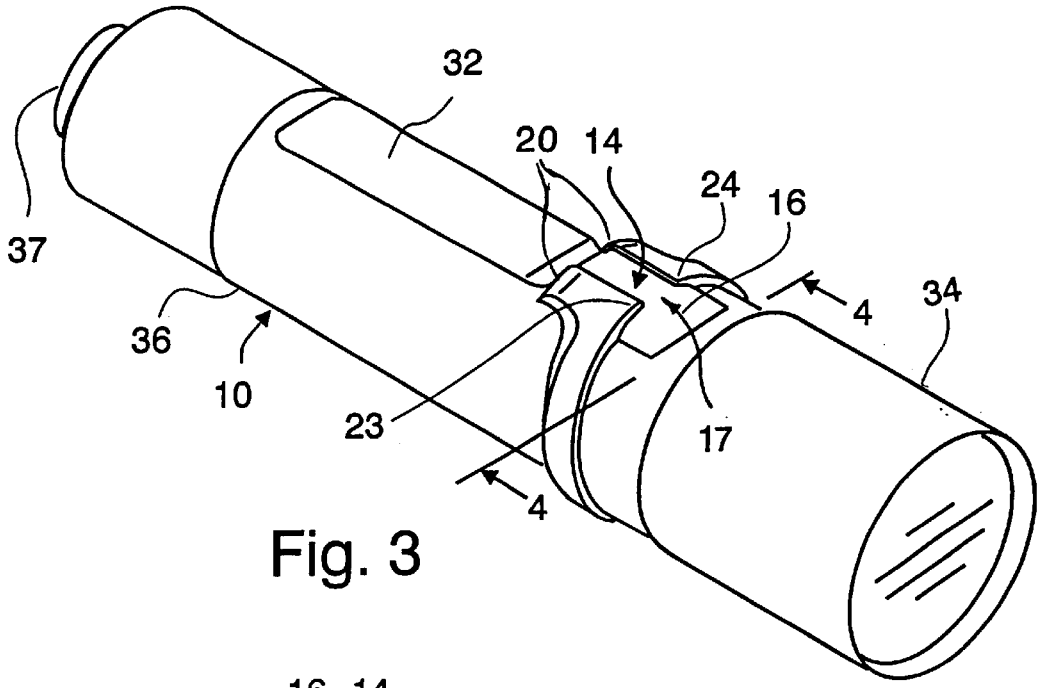
FIG. 3 is a view similar to FIG. 1 with clip and piece of clothing removed.

In practice, this spring-biases the clip head in the undercut groove 14 or under its overhangs 23 and 24. For a realization of such resilient mount of the clip 12, such clip may be placed on the device 10 with the clip head 15 on the outer portion of the flat or other sliding surface 16. The clip is then depressed such as midway between its opposite ends until the head 15 can slide through the opening 17 into the undercut groove 14 as the clip is moved in that direction. At least a portion of the undercut groove 14 may be closed at its other end, such as the closed ends 20 of the lateral grooves 21 and 22 opposite the opening 17 as seen in FIG. 3, preventing the head 15 from exiting the undercut groove 14 during such movement. When the clip is thereupon released, the resiliency of the clip strongly holds its head 15 in the undercut groove below overhangs 23 and 24.

The different features so far disclosed may be used alternatively or in combination.

Accordingly, an end portion of the clip 12 is provided with lateral protrusions 18 and 19 fitting into lateral grooves 21 and 22 below overhangs 23 and 24 of the undercut groove 14 and is bent over toward a remainder of that clip for formation of the head 15 of the clip. In apparatus terms, lateral protrusions 18 and 19 at an end portion of the clip fit into lateral grooves 21 and 22 below overhangs 23 and 24 of the undercut groove 14, and such end portion is bent over toward a remainder of that clip 12 at the head of that clip. In such combination, the mentioned end portion of the clip may be bent over so as to converge toward a remainder of the clip for formation of the head of the clip, such as shown in FIG. 6. The lateral protrusions 18 and 19 again may be offset so as to be in a plane 26 spaced from a plane 28 through the end portion of the clip, such as by a distance or as seen at 27.

The clip 12 may have or be shaped with a projecting portion 31 for engaging the object 13 in conjunction with the portable device 10. According to an embodiment of the invention, this may be combined with the above mentioned bending over of an end portion of the clip, or inclusion of a bent over end portion of that clip, preferably in convergence to an adjacent portion of the clip, such as seen in FIG. 6 at 15 and 29.

FIGS. 1 and 3 show presence or formation of a flat 32 formed on the portable device 10 adjacent the projecting portion 31 of the clip best seen in FIG. 6. In practice, this helps engagement of the object 13 by the clip 12 and device 10.

The portable device 10 may have or be provided with a removable component 34 at the undercut groove 14. The head of the clip may be releasably retained in that undercut groove with that removable component of the portable device. An embodiment of the invention thus may have an attachment clip retainer including a removable component 34 of the portable device 10 at the head 15 of the clip 12. In practice, this helps accidental dislodgment of the clip from the portable device 10. On the other hand, because of the presence of such attachment clip retainer, the head of the clip may be releasably retained in the undercut groove for manual removal of the clip 12 from the portable device 10, such as after a temporary removal of the component 34 from the remainder of the device 10. Accordingly, such portable device may be manually equipped with a clip 12 when desired, but may be used without such clip whenever that is preferred by the user.

The portable device may be or may be shaped as a flashlight having the undercut groove 14, such as seen in FIGS. 1 to 4. In that case such flashlight may have or may be equipped with a lamp housing being the above mentioned component 34 and extending to the vicinity of the undercut groove 14. In this manner, the head 15 of the clip may be retained in that undercut groove with the aid of such lamp housing, such as seen in FIG. 1 which shows the lamp housing 34 secured to the flashlight's battery housing 36 at the installed clip's bent over portion 29, blocking removal of the head 15 from the undercut groove 14 through the opening 17. When the clip is not installed, the removable lamp housing 34 may be secured to the battery housing 36 in the vicinity of the undercut groove's opening 17, as shown in FIG. 3.

In principle, the flashlight may be of a conventional type, having a barrel or housing 36 for containing batteries for energizing an electric light source in the lamp housing at 34, such as via a tailend switch 37 or other ON/OFF switching device.

A clip 12 for attachment of a flashlight 10 or other portable device to an object 13 comprises a combination of a bent over end portion 29 and lateral protrusions 18 and 19 on that bent over portion. Such lateral protrusions preferably are offset so as to be in a plane 26 spaced from a plane 28 through an adjacent portion of that clip, such as seen at 27. Such bent over end portion 29 of the clip 12 again preferably converges toward an adjacent portion of the clip, such as seen in FIGS. 6 at 15 and 29.

Figure 5:
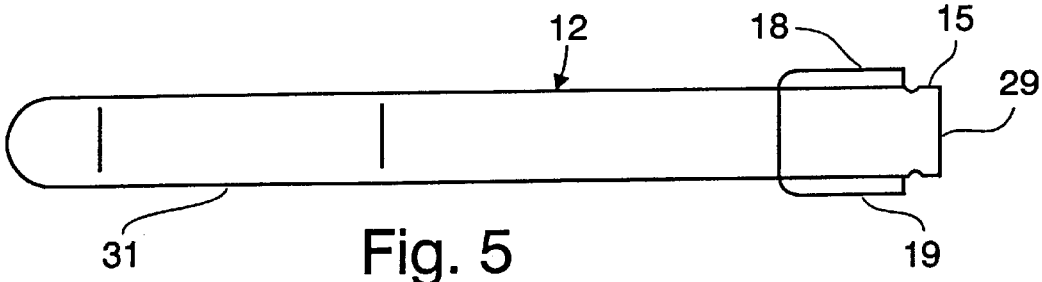
FIG. 5 is a bottom view on an enlarged scale of the clip shown in FIG. 1.

The clip 12 may have an object-engaging projection 31 at an end region of that clip opposite the bent over end portion 29 such as explained above with reference to FIGS. 1, 5 and 6.

This extensive disclosure will render apparent or suggest to those skilled in the art various modifications and variations within the scope of the invention.

I claim:

1. Flashlight apparatus comprising in combination:

a flashlight including a battery housing;

an undercut groove in said battery housing; said undercut groove having an opening at one end thereof, said undercut groove including lateral grooves below overhangs;

a clip including a head removably fitted into said undercut groove through said opening, said clip including a bent over portion at said head, said bent over portion being at said opening, said head having lateral protrusions fitting into said lateral grooves; and a removable component secured to said battery housing at said bent over portion of said clip and blocking removal of said head through said opening.

2. The apparatus according to claim 1, wherein:

said removable component comprises a component of said flashlight.

3. The apparatus according to claim 1, wherein:

said removable component comprises a lamp housing of said flashlight.

4. The apparatus according to claim 1, wherein:

at least a portion of said undercut groove is closed at another end of said undercut groove.

5. The apparatus according to claim 4, wherein:

said removable component is a lamp housing of said flashlight.

6. The apparatus according to claim 1, wherein:

said battery housing includes a sliding surface for said head of said clip extending into said undercut groove at said opening.

7. The apparatus according to claim 1, wherein:

said battery housing includes a flat extending into said undercut groove at said opening.

8. The apparatus according to claim 1, wherein:

said head of said clip is press fit into said undercut groove.

9. The apparatus according to claim 1, wherein:

said lateral grooves are closed at an end thereof opposite said one end of said undercut groove.

10. The apparatus according to claim 1, wherein:

said head of said clip converges toward an adjacent portion of said clip.

11. The apparatus according to claim 1, wherein:

said bent over portion of said clip converges said head toward a remainder of said clip.

12. The apparatus according to claim 1, wherein:

said clip includes a projecting portion for engaging an object in conjunction with said flashlight.

13. The apparatus according to claim 1, wherein:

said flashlight includes a flat adjacent said projecting portion of said clip for engaging the object.

14. Flashlight apparatus comprising in combination:

a flashlight including a battery housing;

an undercut groove in said battery housing, said undercut groove having an opening at one end thereof, said undercut groove having lateral grooves below overhangs;

a clip including a head adapted to be removably fitted into said undercut groove through said opening, said clip including a bent over portion at said head, said bent over portion being at said opening when said head is fitted into said undercut groove, said head having lateral protrusions fitting into said lateral grooves; and a removable component adapted to be secured to said battery housing in the vicinity of said opening of said undercut groove for blocking removal of said head from said undercut groove through said opening.

15. The apparatus according to claim 14, wherein:

said removable component comprises a component of said flashlight.

16. The apparatus according to claim 14, wherein:

said removable component is a lamp housing of said flashlight.

17. The apparatus according to claim 14, wherein:

at least a portion of said undercut groove is closed at another end of said undercut groove.

18. The apparatus according to claim 14, wherein:

said removable component is comprises lamp housing of said flashlight.

19. In a method of equipping a flashlight with a clip for attachment thereof to an object, the steps comprising:

providing a battery housing for the flashlight including an undercut groove in said battery housing, said undercut groove having an opening at one end thereof;

providing a component adapted to be removably secured to said battery housing in the vicinity of said opening;

providing the clip with a head adapted to be removably fitted into said undercut groove through said opening, said head provided with lateral protrusions fitting into lateral grooves below overhangs of said undercut groove;

providing said clip with a bent over portion at said head;

attaching said clip to said flashlight by fitting said head into said undercut groove through said opening with said bent over portion being at said opening; and removably securing said component to said battery housing at said bent over portion for blocking removal of said head from said undercut groove through said opening.

20. The method according to claim 19, wherein:

during said component providing step, said component comprises a component of said flashlight.

21. The method according to claim 19, wherein:

during the component providing step, said component comprises a lamp housing of said flashlight.

22. The method according to claim 19, wherein:

during the battery housing providing step, at least a portion of said undercut groove is closed at another end of said undercut groove.

23. The method according to claim 19, further including:

removing said component from said battery housing;

removing said clip from said flashlight by removing said head from said undercut groove through said opening; and securing said component to said battery housing.

24. The method according to claim 19, wherein:

said battery housing is provided with a sliding surface for said head of said clip extending into said undercut groove through said opening.

25. The method according to claim 24, further including:

during the clip attaching step, sliding said head along said sliding surface.

26. The method according to claim 19, wherein:

said battery housing is provided with a flat extending into said undercut groove through said opening.

27. The method according to claim 19, wherein:

said head of said clip is press fit into said undercut groove.

28. The method according to claim 19, wherein:

said head of said clip is held in said undercut groove by spring action.

29. The method according to claim 19, wherein:

said lateral grooves are closed at an end thereof opposite said one end of said undercut groove.

30. The method according to claim 19, wherein:

the providing said clip with a bent over portion includes bending over an end portion of said clip so that head converges toward a remaining portion of said clip.

31. Flashlight apparatus comprising in combination:

a flashlight including a battery housing;

an undercut groove in said battery housing, said undercut groove having an opening at one end thereof, said undercut groove having lateral grooves below overhangs;

a clip including a head adapted to be removably fitted into said undercut groove through said opening, said head having lateral protrusions fitting into said lateral grooves; and a removable component secured to said battery housing and blocking removal of said head through said opening.

32. The apparatus according to claim 31, wherein:

said removable component comprises a component of said flashlight.

33. The apparatus according to claim 31, wherein:

said removable component comprises a lamp housing of said flashlight.

34. The apparatus according to claim 31, wherein:

at least a portion of said undercut groove is closed at another end of said undercut groove.

35. Flashlight apparatus comprising in combination:

a flashlight including a battery housing;

an undercut groove in said battery housing, said undercut groove having an opening at one end thereof, said undercut groove having lateral grooves below overhangs;

a clip including a head adapted to be removably fitted into said undercut groove through said opening, said head having lateral protrusions fitting into said lateral grooves; and a removable component adapted to be secured to said battery housing in the vicinity of said opening of said undercut groove for blocking removal of said head from said undercut groove through said opening.

36. The apparatus according to claim 35, wherein:

said removable component comprises a component of said flashlight.

37. The apparatus according to claim 35, wherein:

said removable component is a lamp housing of said flashlight.

38. The apparatus according to claim 35, wherein:

at least a portion of said undercut groove is closed at another end of said undercut groove.

39. In a method of equipping a flashlight with a clip for attachment thereof to an object, the steps comprising:

providing a battery housing for the flashlight including an undercut groove in said battery housing, said undercut groove having an opening at one end thereof;

providing a component adapted to be removably secured to said battery housing in the vicinity of said opening;

providing the clip with a head adapted to be removably fitted into said undercut groove through said opening, said head provided with lateral protrusions fitting into lateral grooves below overhangs of said undercut groove;

attaching said clip to said flashlight by fitting said head into said undercut groove through said opening; and removably securing said component to said battery housing for blocking removal of said head from said undercut groove through said opening.

40. The method according to claim 39, wherein:

during said component providing step, said component comprises a component of said flashlight.

41. The method according to claim 39, wherein:

during the component providing step, said component comprises a lamp housing of said flashlight.

42. The method according to claim 39, wherein:

during the battery housing providing step, at least a portion of said undercut groove is closed at another end of said undercut groove.

43. The method according to claim 39, further including:

removing said component from said battery housing;

removing said clip from said flashlight by removing said head from said undercut groove through said opening; and securing said component to said battery housing.

* * * * *

UNITED STATES PATENT AND TRADEMARK OFFICE

CERTIFICATE OF CORRECTION

PATENT NO. : 6,547,415 B1
DATED : April 15, 2003
INVENTOR(S) : John Wallace Matthews It is certified that error appears in the above-identified patent and that said Letters Patent is hereby corrected as shown below:

Title page,
Item [56], U.S. PATENT DOCUMENTS, add:

| | | | | | |
|---|---|---|---|---|---|
| -- | 4,495,551 | * | 1/1985 | Foltz | 362/205 |
| | 4,517,628 | * | 5/1985 | McDermott | 362/186 |
| | 4,563,728 | * | 1/1986 | Bruggerman | 362/206 -- |

Column 4,
Line 27, “FIGS.” should be -- FIG. --.

Column 5,
Line 19, “claim 1” should be -- claim 12 --.
Line 48, “claim 14” should be -- claim 17 --.

Column 6,
Line 43, -- said -- should be inserted before “head”.
Line 52, “adapted to be” should be deleted.

Signed and Sealed this

Fifth Day of August, 2003

JAMES E. ROGAN
*Director of the United States Patent and Trademark Office*